US008091454B1

(12) United States Patent
West et al.

(10) Patent No.: US 8,091,454 B1
(45) Date of Patent: Jan. 10, 2012

(54) JEWELRY TOOL

(76) Inventors: Charles E. West, Tampa, FL (US); Tracy L. Sanderson, Tampa, FL (US)

( * ) Notice: Subject to any disclaimer, the term of this patent is extended or adjusted under 35 U.S.C. 154(b) by 183 days.

(21) Appl. No.: 12/384,056

(22) Filed: Mar. 30, 2009

Related U.S. Application Data

(60) Provisional application No. 61/041,265, filed on Apr. 1, 2008.

(51) Int. Cl.
*B25B 13/06* (2006.01)
*B25B 13/48* (2006.01)

(52) U.S. Cl. ..... 81/120; 81/125

(58) Field of Classification Search ..... 81/120, 81/122, 125, 6, 7, 8
See application file for complete search history.

(56) References Cited

U.S. PATENT DOCUMENTS

| | | | | |
|---|---|---|---|---|
| 2,519,439 | A * | 8/1950 | Cozart | 81/122 |
| 3,186,263 | A | 6/1965 | Grote | |
| 3,253,485 | A | 5/1966 | Grote | |
| 4,615,242 | A | 10/1986 | Milin | |
| 4,846,025 | A | 7/1989 | Keller et al. | |
| 4,867,017 | A | 9/1989 | Holman | |
| 5,065,649 | A | 11/1991 | Eveers et al. | |
| 5,887,631 | A * | 3/1999 | Eaton | 140/118 |
| 6,138,538 | A * | 10/2000 | Neijndorff | 81/451 |
| 6,244,073 | B1 | 6/2001 | Kaping, Jr. | |
| 6,606,924 | B2 * | 8/2003 | Chandler et al. | 81/90.2 |
| 7,241,385 | B1 | 7/2007 | Cline | |
| 7,287,452 | B1 | 10/2007 | Tsai | |
| 7,318,811 | B1 | 1/2008 | Corbishley | |
| 2002/0078797 | A1 * | 6/2002 | Oyabu | 81/6 |

* cited by examiner

*Primary Examiner* — David B Thomas
(74) *Attorney, Agent, or Firm* — Frijouf, Rust & Pyle, P.A.

(57) ABSTRACT

A jewelry tool is disclosed for engaging a body jewelry. The jewelry tool comprises a tubular body having an interior chamber. A tubular core extends between a major end and a minor end. The tubular core is made of a deformable polymeric material. The tubular core is positioned within the tubular body. A bead bore defines a bore dimension and traverses into the tubular core from the major end. The bore dimension of the bead bore is less than a bead dimension of a bead for deforming the bead bore relative to the bead upon insertion of said bead into said bead bore for creating a friction couple. The friction couple secures the bead relative to the tubular body and transfers a rotational force from the tubular body to the bead for threadably engaging and disengaging the bead with a shaft.

10 Claims, 7 Drawing Sheets

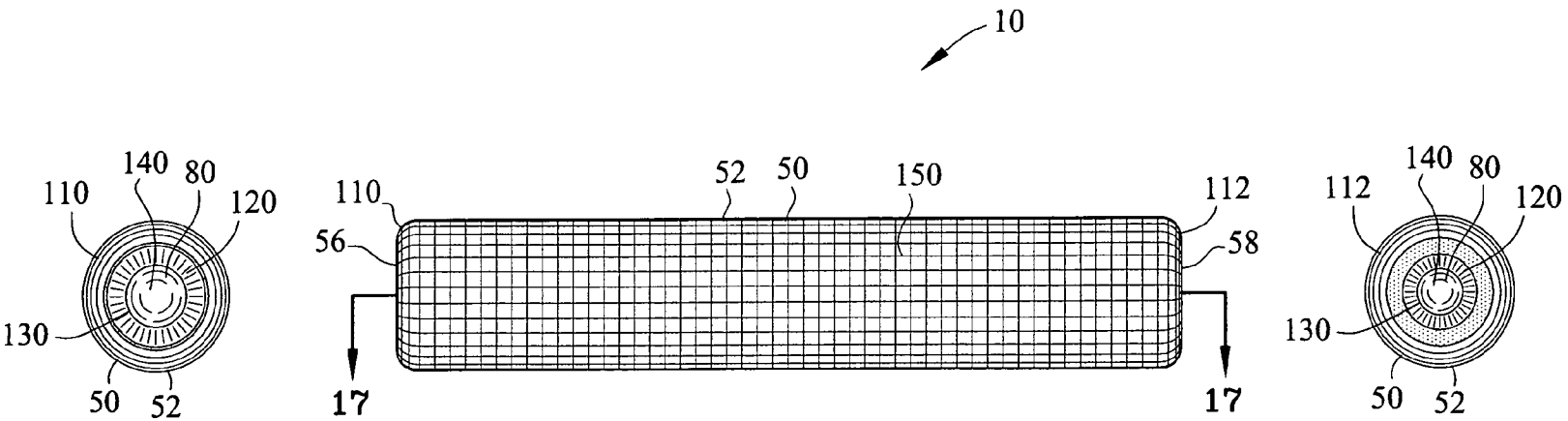
FIG. 14
FIG. 15
FIG. 16
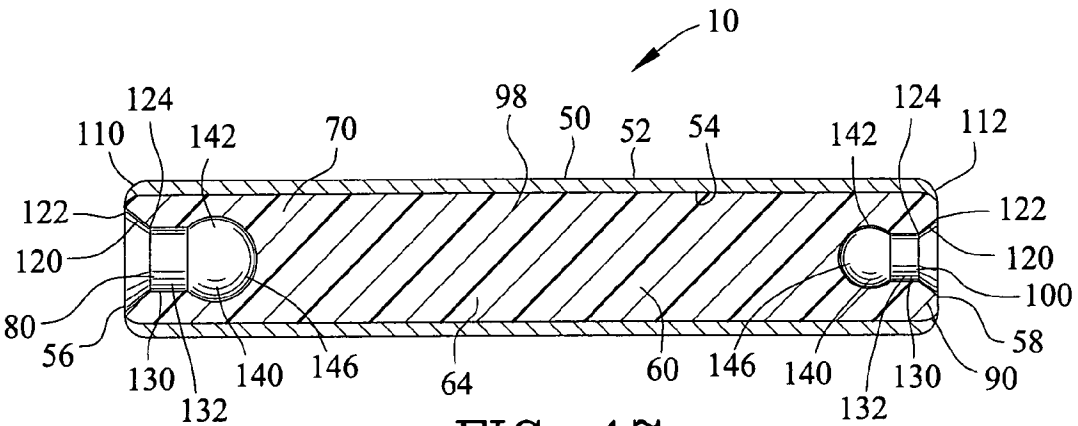
FIG. 17

JEWELRY TOOL

CROSS-REFERENCE TO RELATED APPLICATIONS

This application claims benefit of U.S. Patent Provisional application Ser. No. 61/041,265 filed Apr. 1, 2008. All subject matter set forth in provisional application Ser. No. 61/041,265 is hereby incorporated by reference into the present application as if fully set forth herein.

BACKGROUND OF THE INVENTION

1. Field of the Invention

This invention relates to tools and more particularly to a jewelry tool for engaging a body jewelry.

2. Background of the Invention

The popularity and acceptance of body jewelry has risen sharply in recent years. Body piercings and subsequent insertion of decorative jewelry has created a demand for a variety of forms of decorative body jewelry. One of the more popular forms of body jewelry comprises a group known as "bar bell" jewelry. Bar bell jewelry is made by attaching a ball at each end of a bar. The bar may be straight, curved or circular. The balls are attached to the bar by internal or external threads. In order to achieve an attractive appearance, the balls are typically sized in the 2 to 12 millimeter range. Attaching a ball within this size range to a bar inserted through a piercing in various parts of the anatomy can present substantial difficulty to the user. The small size of the ball relative to the size of the user's fingers has presented a problem that has, thus far, not been adequately addressed by the prior art. Some examples of tools of the prior art are included below.

U.S. Pat. No. 3,186,263 to W. F. Grote discloses improvements in a tool for safely releasing, removing and replacing the cap of an automobile radiator.

U.S. Pat. No. 3,253,485 to W. F. Grote discloses further improvements in a tool for safely releasing, removing and replacing the cap of an automobile radiator.

U.S. Pat. No. 4,615,242 to I. Milin discloses a bottle opener for bottles having twist-off caps including a container having an end wall with an opening therein adapted for insertion of a bottle-mounted cap therein. A cylindrical member is connected to and extends into the container from the opening. The cylindrical member is open at the end thereof opposite the opening in the end wall and has a passageway adapted for passage of bottle caps through the cylindrical member and into the container. Longitudinal ridges on the interior of the cylindrical member hold an inserted bottle-mounted cap so that turning of the container about a longitudinal axis thereof extending perpendicular to the end wall causes the removal of the cap from its bottle. Preferably the opener includes means such as resilient fingers for preventing detached caps in the cylindrical member from falling out through the opening in the end wall.

U.S. Pat. No. 4,846,025 to J. Keller et al. discloses a tool for removing radiator caps. The tool has a hollow handle and a flanged hollow face. The hollow face has a recess with a perimeter. The perimeter has a pair of opposed rectangular indentations, at least one pair of opposed arcuate indentations, and a pair of tapering indentations which interrupt the perimeter to form a pair of opposed openings.

U.S. Pat. No. 4,867,017 to M. Holman discloses a tool for use when changing the oil filter of an engine and refilling or putting oil into the engine. The tool is generally funnel shaped, having an internal surface which frictionally engages the oil filter after its seal has been broken. The tool has an extended portion of a greater diameter than the filter to catch any oil which escapes as the filter is removed. The escaping oil is channeled to the outlet portion of the funnel, to which a plastic tubing may be positioned to remove the escaping oil. The tool may then be used as a funnel to fill the engine and complete the oil changing process U.S. Pat. No. 5,065,649 to D. Eveers et al. discloses a screw holding device of elastic material having a tube-shaped top end and a dome-shaped bottom end for fitting securely over the head of a screw or bolt to insure the availability of the screw or bolt by its being held securely in the dome end's interior multiple gripping means which are easily releasable when the screw or bolt is seated.

U.S. Pat. No. 6,244,073 to D. Kaping, Jr. discloses a cap for body piercing jewelry having a retention member for resisting passage through a pierced passageway. The retention member is composed of a plastic material. An enlarged end of a shank is anchored into the retention member with a threaded stud extending therefrom. The process to make the cap includes positioning viscous plastic material in a mold to produce the desired retention member shape. The enlarged portion of the shank is inserted and embedded into the plastic material. The enlarged portion of the shank has a pointed tip which enables the enlarged end of the shank to be inserted into the plastic material without producing visible unsightly air bubbles. As the shank is inserted into plastic material, the plastic material flows into anchors on the enlarged portion of the shank to assist in securing and locking the shank to the retention member.

U.S. Pat. No. 7,241,385 to D. Cline discloses an oil filter canister removal tool comprising a cup-shaped plastic body long enough to receive the filter therein and of sufficient diameter as to provide radial clearance between the filter canister and the top rim of the body. A snug fit can be provided by integral flutes or bonded in strips of elastomeric material. In operation the tool is slipped over a canister after the canister has been loosened relative to the engine block. The tool is manually rotated until the canister is free of the engine. The tool can be cleaned up and reused after disposal of the oil filter canister. The tool may also be thrown away with the used filter.

U.S. Pat. No. 7,287,452 to A. Tsai discloses a screw fastener assembly including a resilient sleeve sleeved on a head portion of the screw fastener in a close-fitting manner such that a free end of a shank portion of the screw fastener extends outwardly of a first end of the sleeve. The sleeve permits extension of a bit of a screw driver thereinto via a second end thereof, and is sleeved on the screw driver in a close-fitting manner. An engaging groove in the head portion of the screw fastener engages the bit of the screw driver such that the screw driver is capable of moving and rotating an assembly of the screw fastener and the sleeve until the first end of the sleeve comes into contact with a surface of an object so as to allow movement of the screw fastener relative to the sleeve and a threaded hole in the object.

U.S. Pat. No. 7,318,811 to C. Corbishley discloses a vibratory body jewelry item for attachment to the tongue or other body parts comprising one or more motor and battery casings and a post connecting said casings having various improvements including a gripping member to facilitate opening and closing of said casings, an longer lasting battery and motor combination, a kit including extra batteries and alternative casing sizes, and a band or suction cup for attaching said item to other unpierced body parts.

Although the aforementioned prior art have contributed to the development of the art of gripping tools, none of these prior art patents have solved the needs of the bar bell body jewelry art.

Therefore, it is an object of the present invention to provide an improved tool for the attachment of a ball to bar bell body jewelry.

Another object of this invention is to provide an improved tool for the attachment of a ball to bar bell body jewelry which reduces the skill required to attach a ball to the bar.

Another object of this invention is to provide an improved tool for the attachment of a ball to bar bell body jewelry which is easy to manufacture.

Another object of this invention is to provide an improved tool for the attachment of a ball to bar bell body jewelry which is low in cost.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention a jewelry tool. The jewelry tool engages a body jewelry. The body jewelry is coupled to a living organism. The body jewelry has a shaft extending between a first end and a second end for traversing the living organism. The first end of the shaft includes a first threading. A bead defines a bead shape and a bead dimension. The bead has a second threading threadably engaging the first threading of the shaft for securing the bead to the shaft. The bead prohibits the body jewelry from being withdrawn from the living organism. The jewelry tool comprises a tubular body having an exterior surface and an interior surface for extending between a primary end and a secondary end. The interior surface of the tubular body defines an interior chamber extending between the primary end and the second secondary end. The primary end has a primary aperture for accessing the interior chamber. A tubular core extends between a major end and a minor end for defining an outer surface. The outer surface of the tubular core is positioned adjacent to the interior surface of the tubular body for securing the major end of the tubular core adjacent to the primary end of the tubular body. A bead bore defines a bore dimension and traverses into the tubular core from the major end of the tubular core. The bore dimension of the bead bore is less than the bead dimension of the bead for displacing the bead bore relative to the bead. The bead bore receives the bead for creating a friction coupling. The friction coupling secures the bead relative to the tubular body and transferres a rotational force from the tubular body to the bead for threadably engaging and disengaging the second threading of the bead with the first threading of the shaft.

In a more specific embodiment of the invention, the secondary end has a secondary aperture for accessing the interior chamber. A second tubular core extends between a major end and a minor end for defining a second outer surface. The second outer surface of the second tubular core is positioned adjacent to the interior surface of the tubular body for securing the major end of the second tubular core adjacent to the secondary end of the tubular body. A second bead bore defines a second bore dimension and traverses into the second tubular core from the major end of the second tubular core. The second bore dimension of the second bead bore is less than the bead dimension of the bead for displacing the second bead bore relative to the bead. The second bore dimension of the second bead bore is greater than the bore dimension of the bead bore for accommodating beads with various dimensions. The second bead bore receives the bead for creating a second friction couple. The second friction couple secures the bead relative to the tubular body and transferrer a rotational force from the tubular body to the bead for threadably engaging and disengaging the second threading of the bead with the first threading of the shaft.

In one embodiment of the invention, the primary end of the tubular body includes an inner arcuate lip for increasing the contact surface area between the interior surface of the tubular body and the outer surface of the tubular core and prevents the tubular core from being displaced from the tubular body during disengaging of the bead from the bead bore.

In another embodiment of the invention, the bead bore includes a conical bore having an exterior dimension at the major end of the tubular core and an interior dimension within the tubular core. The exterior dimension of the conical bore is greater than the interior dimension of the conical bore for directing the head into the bead bore.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which:

FIG. 14 is a side view second embodiment of the jewelry tool incorporating the present invention;

FIG. 15 is a left side view of FIG. 14;

FIG. 16 is a right side view of FIG. 14;

FIG. 17 is a section view along line 17-17 in FIG. 14;

Similar reference characters refer to similar parts throughout the several Figures of the drawings.

DETAILED DISCUSSION

Figure 1:
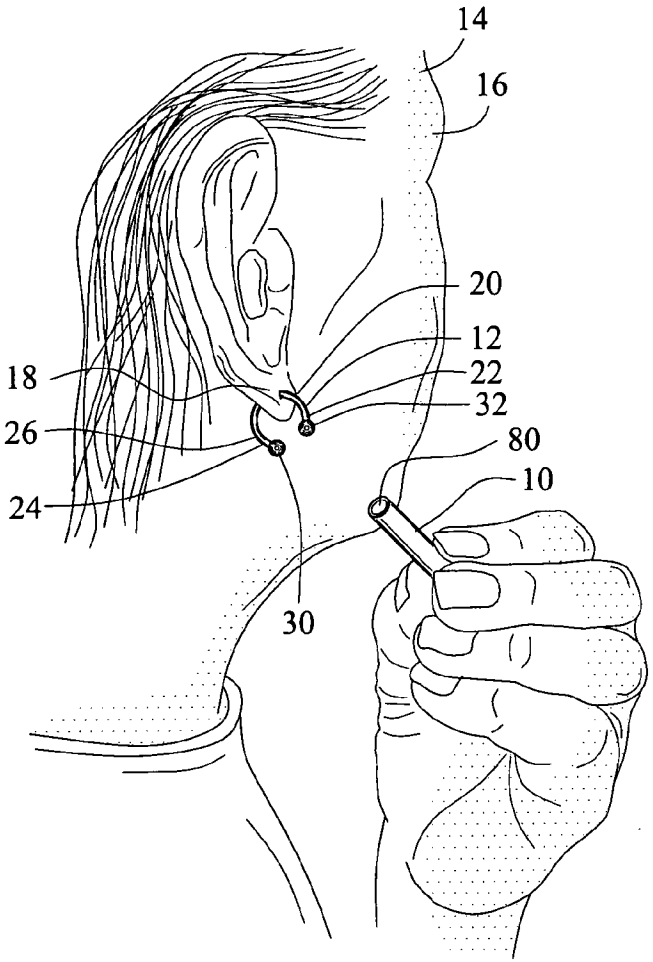
FIG. 1 is an isometric view of jewelry tool prior to engaging a body jewelry incorporating the present invention.
Figure 2:
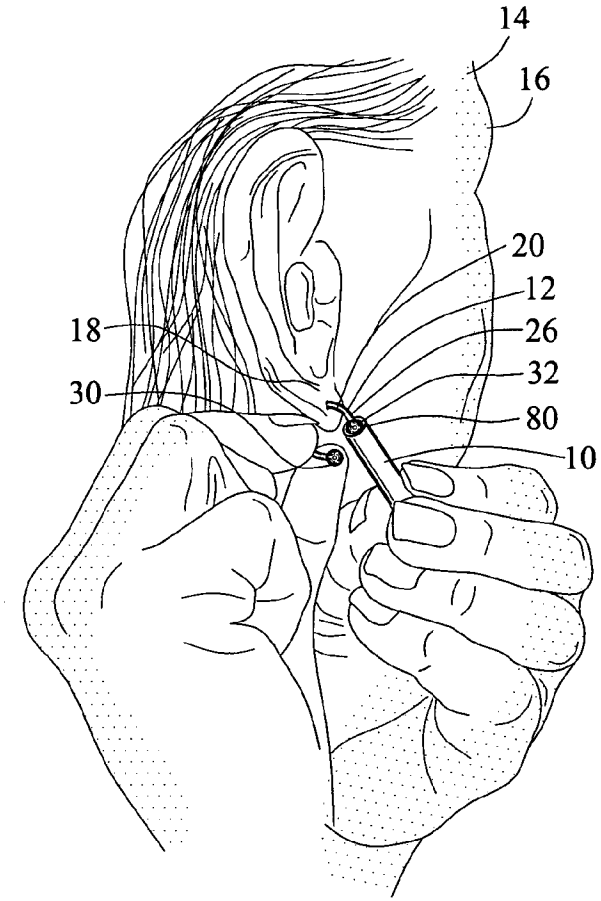
FIG. 2 is a view similar to FIG. 1 illustrating the jewelry tool engaging the body jewelry.
Figure 4:
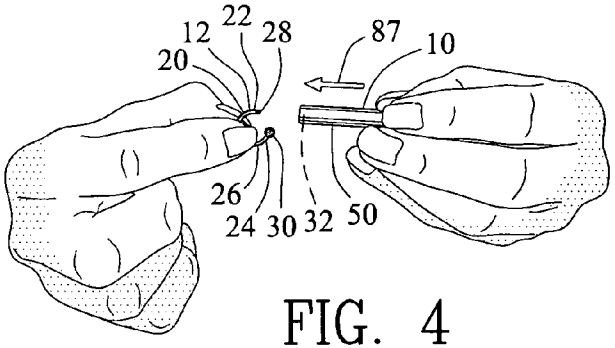
FIG. 4 is a side view of the jewelry tool and body jewelry illustrating the bead embedded within the jewelry tool for securing the bead to the body jewelry.
Figure 5:
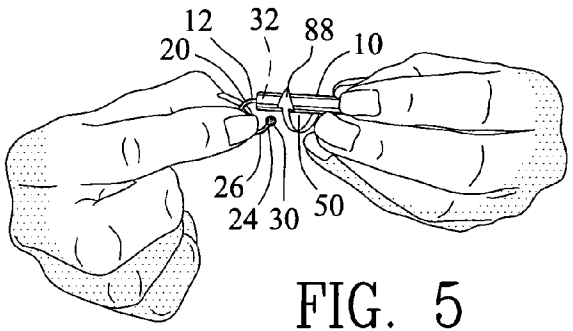
FIG. 5 is a view similar to FIG. 4 illustrating the jewelry tool utilized for engaging the bead with the body jewelry and thereafter rotating the jewelry tool for threadably engaging the bead with the body jewelry.
Figure 6:
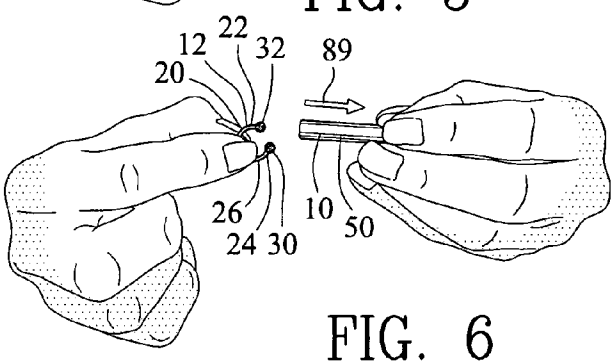
FIG. 6 is a view similar to FIG. 5 illustrating the bead threadably attached to the body jewelry and thereafter the jewelry tool disengaged from the bead.
Figure 3:
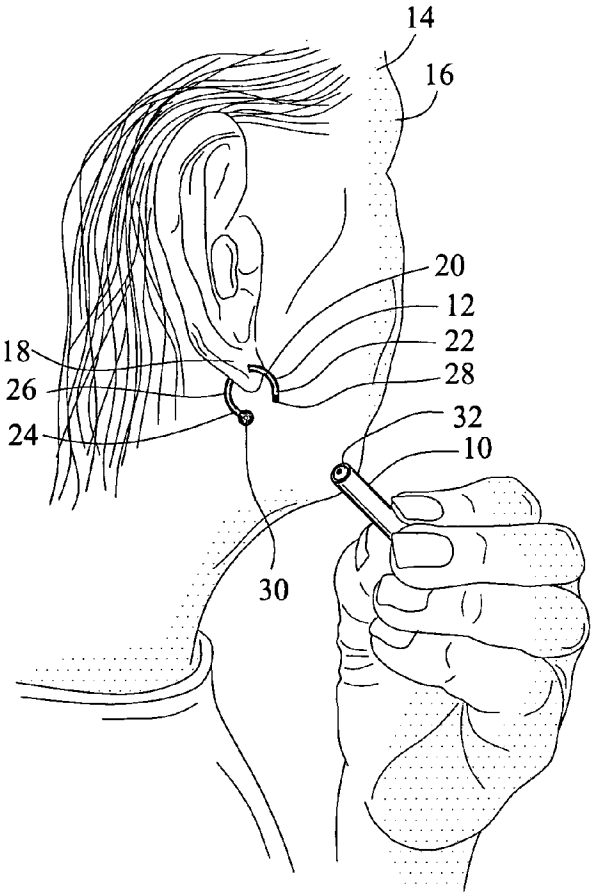
FIG. 3 is a view similar to FIG. 2 illustrating the bead engaged within the jewelry tool and removed from the body jewelry.
Figure 9:
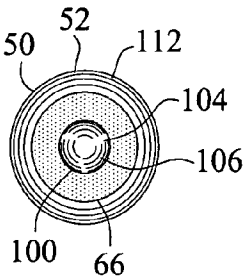
FIG. 9 is a right side view of FIG. 7.
Figure 7:
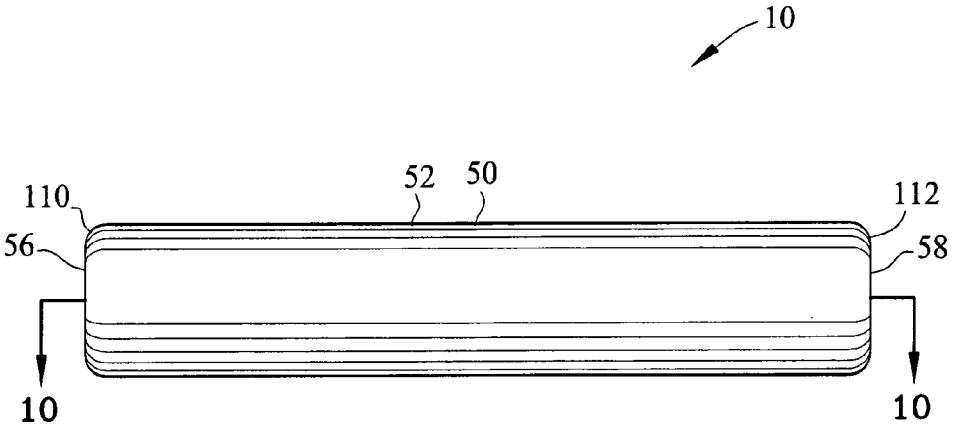
FIG. 7 is a side view first embodiment of the jewelry tool incorporating the present invention.
Figure 8:
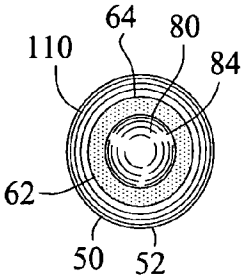
FIG. 8 is a left side view of FIG. 7.

FIGS. 1-13 are various views of a first embodiment including a jewelry tool 10 for engaging a body jewelry 12. The body jewelry 12 is coupled to a living organism 14. The body jewelry 12 has a shaft 20 extending between a first end 22 and a second end 24 for traversing the living organism 14. The living organism 14 is shown to include a human being wherein in the body jewelry 12 traverses the ear lobe of the human. The body jewelry 12 may be secured in other regions of the human being. Furthermore, the living organism 14 may include animals or other life forms.

Figure 21:
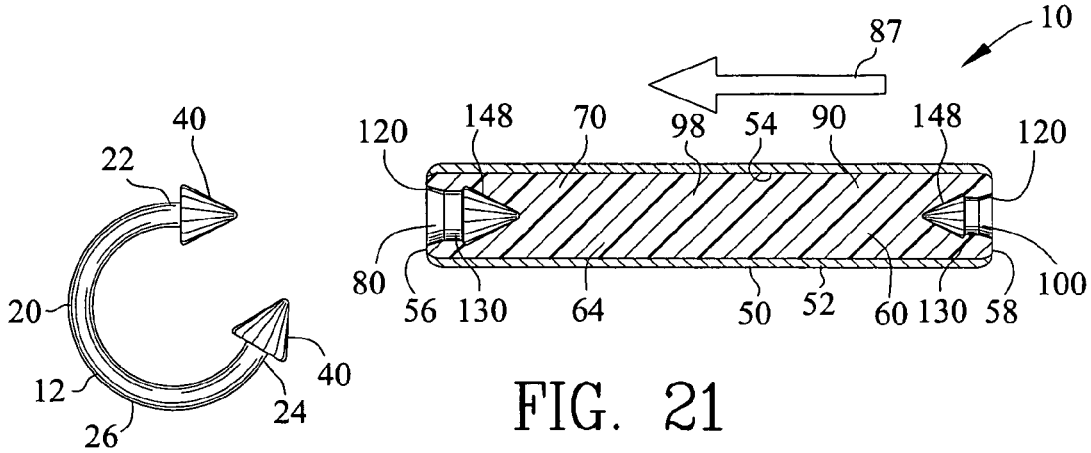
FIG. 21 is a side view third embodiment of the jewelry tool illustrating the jewelry tool prior to engaging a body jewelry including a circular barbell with a cone bead.
Figure 22:
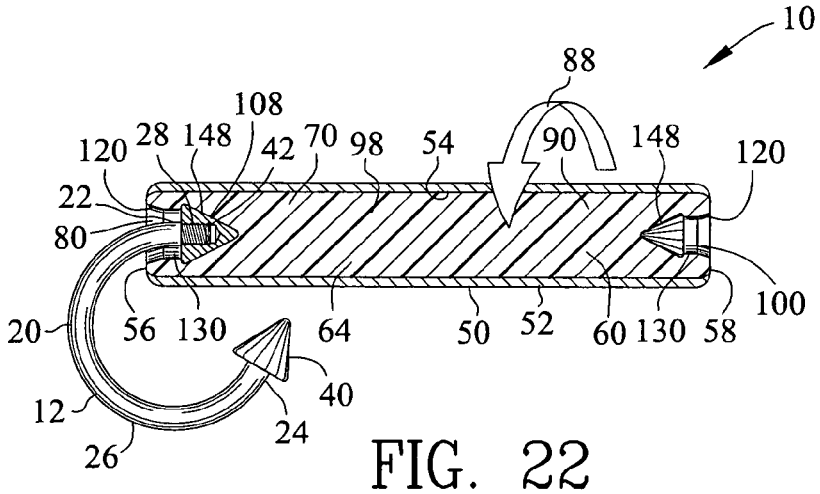
FIG. 22 is a view similar to FIG. 21 illustrating the jewelry tool engaging the body jewelry and thereafter rotating the jewelry tool for threadably disengaging the bead with the body jewelry.
Figure 23:
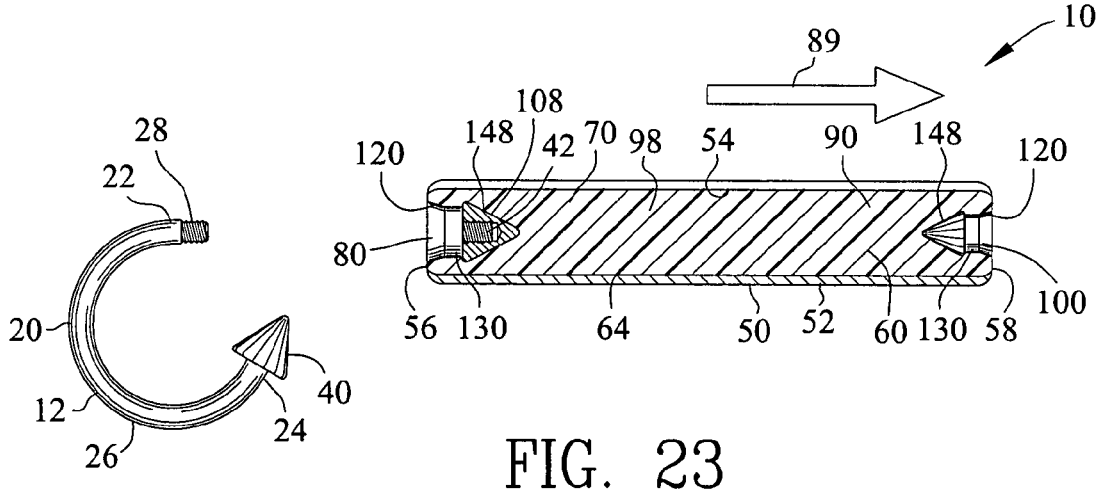
FIG. 23 is a view similar to FIG. 22 illustrating the jewelry tool retaining the bead after disengaging the bead with the body jewelry.

FIGS. 1-13 illustrate the shaft 20 of the body jewelry 12 including a circular barbell 26. The first end 22 of the shaft 20 includes a first threading 28. The second end 24 may include a fixed bead 30. A removable bead 32 is threadably engaged with the first end 22. The removable bead 32 defines a bead shape 34 and a bead dimension 36. The bead shape 34 is illustrated in FIGS. 1-13, to include a spherical geometry 38. FIGS. 21-23 illustrate the removable bead 32 to include a cone geometry 40, however, the removable bead 32 may further include a cuban, triangle, cylindrical, disk or other shapes.

The removable bead 32 has a second threading 42 for threadably engaging the first threading 28 of the shaft 20. The engagement between the first threading 28 and the second threading 42 secures the removable bead 32 to the shaft 20. The removable bead 32 prohibits the body jewelry 12 from being withdrawn from the living organism 14.

In order to facilitate the engagement and disengagement of the removable bead 32 from the shaft 20, the jewelry tool can be utilized to grasp the removable beat 32. The jewelry tool 10 comprises a tubular body 50 having an exterior surface 52 and an interior surface 54 for extending between a primary end 56 and a secondary end 58. The interior surface 54 of the tubular body 50 defines an interior chamber 60 extending between the primary end 56 and the second secondary end 58. The primary end 56 has a primary aperture 62 for accessing the interior chamber 60. The tubular body 50 may include a circular cross-section 64 as shown in FIGS. 1-23. However, the tubular body 50 may include other geometric shapes including but not limited to triangular cross-section or square cross-section. The tubular body 50 may be constructed of a metallic, polymeric or other rigid material.

As best seen in FIGS. 7-10, the jewelry tool 10 further includes a tubular core 70 extends between a major end 72 and a minor end 74 for defining an outer surface 76. The outer surface 76 of the tubular core 70 is positioned adjacent to the interior surface 54 of the tubular body 50 for securing the major end 72 of the tubular core 70 adjacent to the primary end 56 of the tubular body 50. The tubular core 70 may be constructed of a soft polymeric material such that it is easily deformable.

The tubular core 70 has a bead bore 80 traverses into the tubular core 70 from the major end 72 of the tubular core 70. The bead bore 80 defines a bore dimension 82 and a bore cross-sectional shape 84. The bore cross-sectional shape 84 may include a circular cross-section 64 as shown in FIGS. 1-23. However, the bore cross-sectional shape 84 may include other geometric shapes including but not limited to triangular cross-section or square cross-section. Preferably, the bore dimension 82 of the bead bore 80 is less than the bead dimension 36 of the bead 32 for displacing the bead bore 80 relative to the bead 32. The bead bore 80 receives the bead 32 for creating a friction couple 86. The friction couple 86 secures the bead 32 relative to the tubular body 50 and transfers a rotational force 88 from the tubular body 50 to the bead 32 for threadably engaging and disengaging the second threading 42 of the bead 32 with the first threading 28 of the shaft 20.

The secondary end 58 may include a secondary aperture 66 for accessing the interior chamber 60. A second tubular core 90 extends between a major end 92 and a minor end 94 for defining a second outer surface 96. The second outer surface 96 of the second tubular core 90 is positioned adjacent to the interior surface 54 of the tubular body 50 for securing the major end 92 of the second tubular core 90 adjacent to the secondary end 58 of the tubular body 50. The second tubular core 90 may be constructed of a soft polymeric material such that it is easily deformable. Preferably the comprises an integral one-piece unit 98 extending between the primary end 56 and the secondary end 58 of the tubular body 50.

The second tubular core 90 has a second bead bore 100 traversing into the second tubular core 90 from the major end of the second tubular core 90. The second bead core 100 defines a second bore dimension 102 and a second bore cross-sectional shape 104. The second bore cross-sectional shape 104 may include a second circular cross-section 106 as shown in FIGS. 1-23. However, the second bore cross-sectional shape 104 may include other geometric shapes including but not limited to triangular cross-section or square cross-section.

Preferably, the second bore dimension 102 of the second bead bore 100 is less than the bead dimension 36 of the bead 32 for displacing the second bead bore 100 relative to the bead 32.

Figure 10:
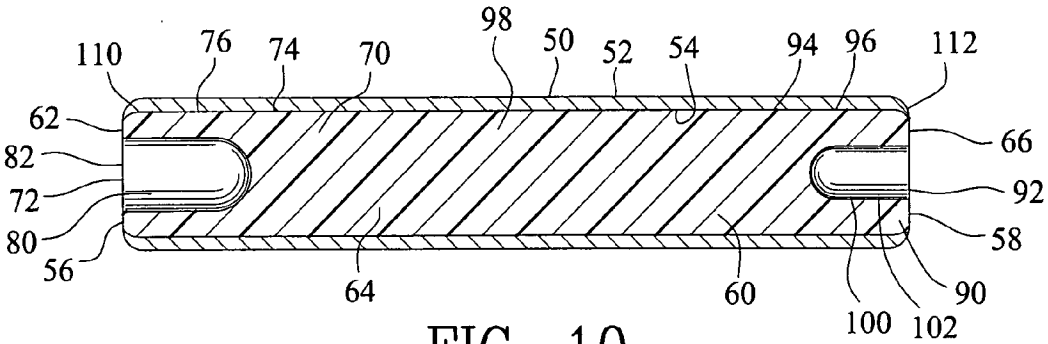
FIG. 10 is a section view along line 10-10 in FIG. 7.
Figure 11:
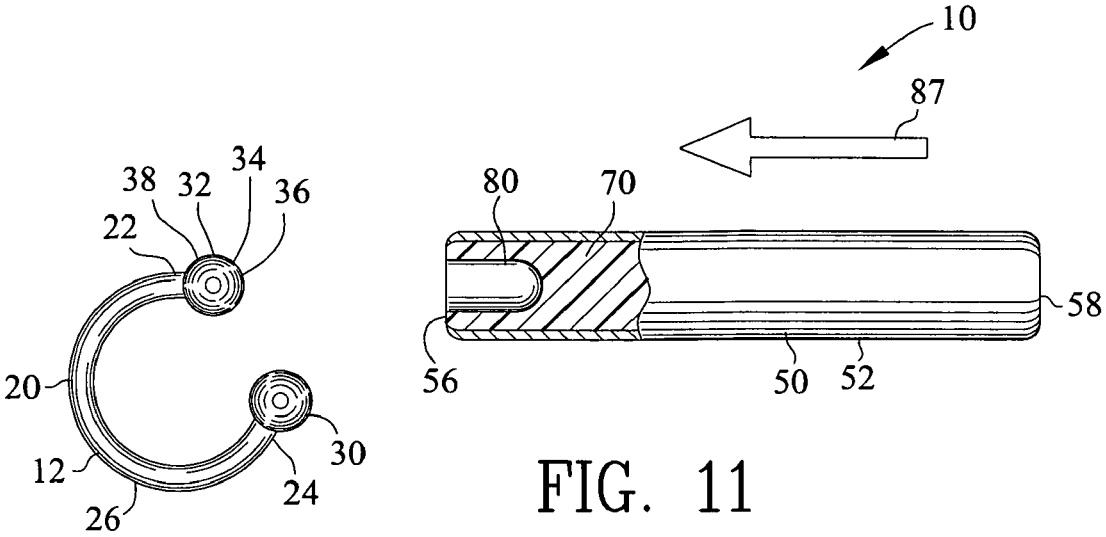
FIG. 11 is a view similar to FIG. 10 illustrating the jewelry tool prior to engaging a body jewelry including a circular barbell.
Figure 12:
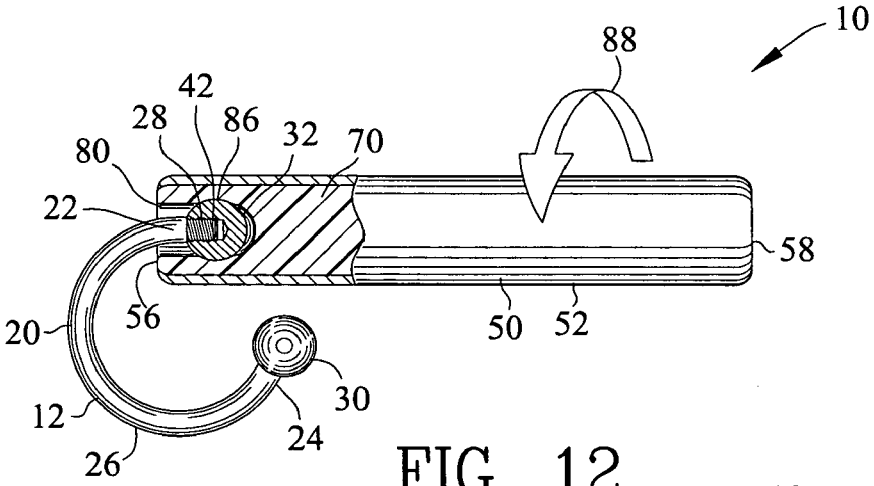
FIG. 12 is a view similar to FIG. 11 illustrating the jewelry tool engaging the body jewelry and thereafter rotating the jewelry tool for threadably disengaging the bead with the body jewelry.
Figure 13:
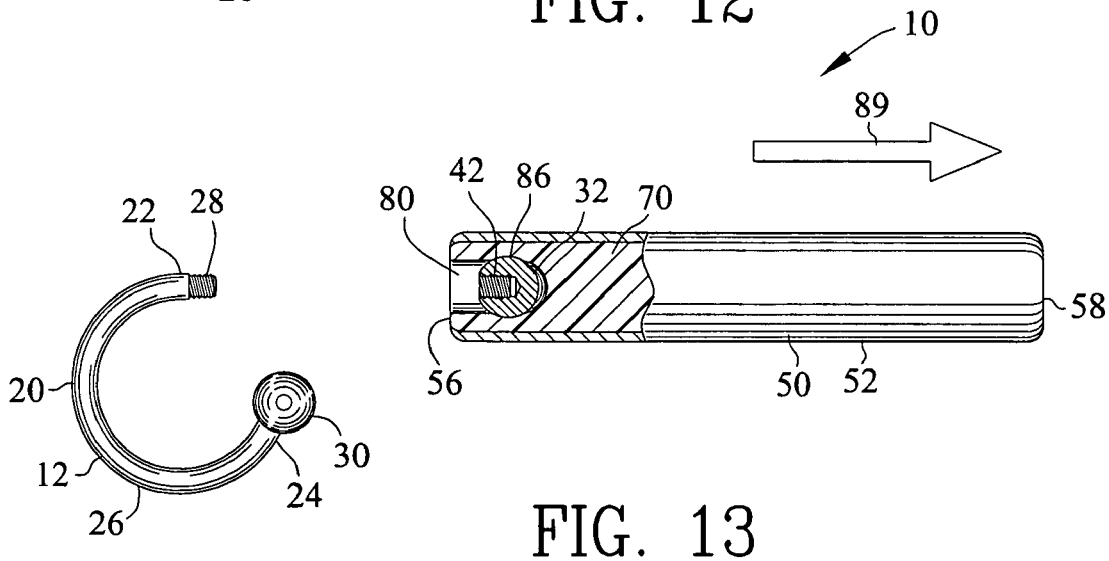
FIG. 13 is a view similar to FIG. 12 illustrating the jewelry tool retaining the bead after disengaging the bead with the body jewelry.
Figure 18:
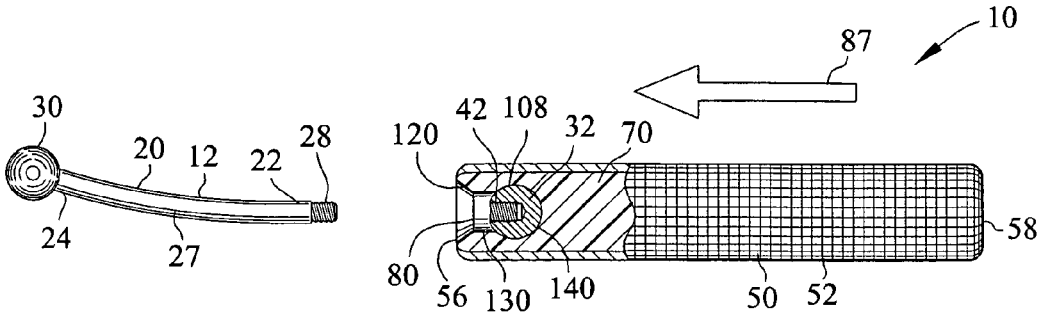
FIG. 18 is a view similar to FIG. 17 illustrating the jewelry tool retaining the bead prior to engaging the bead with the body jewelry including a curved barbell.
Figure 19:
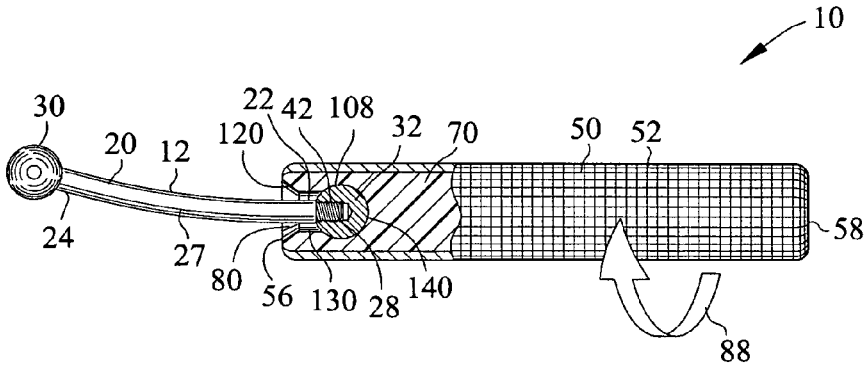
FIG. 19 is a view similar to FIG. 18 illustrating the jewelry tool engaging the body jewelry and thereafter rotating the jewelry tool for threadably engaging the bead with the body jewelry.
Figure 20:
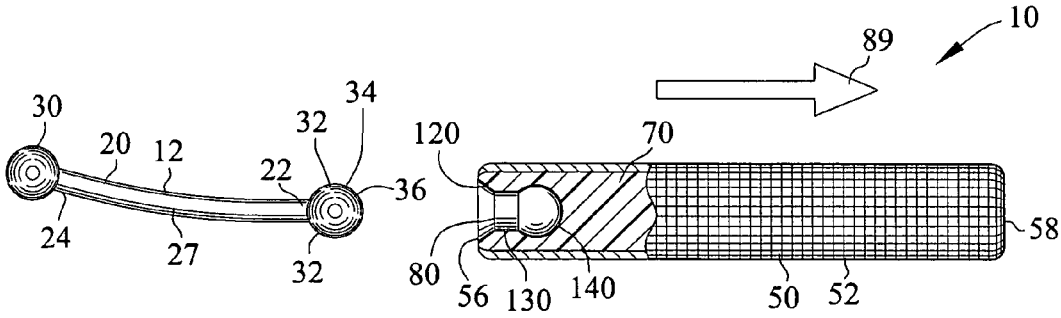
FIG. 20 is a view similar to FIG. 19 illustrating the jewelry tool disengaging with the bead after the bead has threadably engaged with the body jewelry.

As seen in FIG. 10, the second bore dimension 102 of the second bead bore 100 is less than the bead dimension 36 of the bead 32 for displacing the second bead bore 100 relative to the bead 32. Preferably, the second bore dimension 102 of the second bead bore 100 is greater than the bore dimension 82 of the bead bore 80 for accommodating beads 32 with various dimensions. For example, the bead bore 80 may include a three millimeter diameter and the second bead bore 100 may include a four millimeter diameter. Furthermore, the bead bore 80 and the second beat bore 100 may have diameters varying from 2 millimeter to 12 millimeter. The second bead bore 100 receives the bead 32 for creating a second friction couple 108. The second friction couple 108 secures the bead 32 relative to the tubular body 50 and transferres a rotational force 88 from the tubular body 50 to the bead 32 for threadably engaging and disengaging the second threading 42 of the bead 32 with the first threading 28 of the shaft 20.

The primary end 56 and the secondary end 58 of the tubular body 50 may include a first inner arcuate lip 110 and a second inner arcuate lip 112 respectively. The first inner arcuate lip 110 and a second inner arcuate lip 112 increases the contact surface area between the interior surface 54 of the tubular body 50 and the outer surface 76 of the tubular core 70 and prevents the tubular core 70 from being displaced from the tubular body 50 during disengaging of the bead 32 from the bead bore 80.

As best seen in FIGS. 10-13, 17-23, the bead bore 80 and the second bead bore 100 may include a conical bore 120 having an exterior dimension 122 at the major end 72, 92 of the tubular core 70 and an interior dimension 124 within the tubular core 70. The exterior dimension 122 of the conical bore 120 is greater than the interior dimension 124 of the conical bore 120 for directing the bead 32 into the bead bore 80 and the second bead bore 100.

The bead bore 80 and the second bead bore 100 may further include a central bore 130 defining a central bore dimension 132. The central bore 130 traverses into the tubular core 70 from the conical bore 120. Preferably, the central bore dimension 132 is equivalent to the interior dimension 124 of the conical bore 120 for receiving the bead 32 within the bead bore 80 and the second bead bore 100.

The bead bore 80 and the second bead bore 100 may also include a bead cavity 140. The bead cavity 140 defines a cavity dimension 142 that traverses into the tubular core 70 from the central bore 130. The cavity dimension 142 is greater than the central bore dimension 132 for locking the bead 32 within the bead cavity 140. Preferably, the bead cavity 140 defines a cavity shape 144 equivalent to the bead shape 34 of the bead 32 for increasing the contact area between the bead 32 and the bead bore 80 and the second bead bore 100. The cavity shape 144 is illustrated in FIGS. 1-13, to include a spherical cavity 146. FIGS. 21-23 illustrate the cavity shape 144 to include a cone cavity 148, however, the cavity shape 144 may further include a cuban, triangle, cylindrical, disk or other shapes.

As best seen in FIGS. 18-20 and 14, the exterior surface 52 of the tubular body 50 including a textured surface 150 for assisting in grasping the tubular body 50 and applying a rotational force 88 to the tubular body 50.

FIGS. 11-13 and 21-23 illustrate the process for removing the bead 32 from the shaft 20. A tensile force 74 is utilized to implant the bead 32 within the tubular core 70. Upon implantation of the bead 32 within the tubular core 70, the bead core 80 expands for permit the bead 32 to traverse tubular core 70. The expansion of the bead core 80 causes a compression of the tubular core 70 material. The compressed tubular core 70 in turn causes a frictional couple 86 between the tubular core 70 and the bead 32. The frictional couple 86 retains the bead 32 in a fixed position relative to the jewelry tool 10 for the bead 32 to receive first a rotational force 88 and then a tensile force 89 to withdraw the bead 32 from the shaft 20. The jewelry tool 10 maintains the bead 32 within the bead core 80 until the bead 32 is reattached to the shaft 20.

FIGS. 4-6 and 18-20 illustrate the process for reengaging the bead 32 with the shaft 20. A tensile force 87 is applied to the jewelry tool 10 for mating the shaft 20 would the bead 32. A rotational force is then applied to the jewelry tool 10 for causing a threadable engagement between the first threading 28 and the second threading 42. Thereafter, a tensile force is applied to the jewelry tool 10 for overcoming the frictional couple 86 and disengaging the bead 32 from the tubular core 70.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A jewelry tool for engaging a body jewelry, the body jewelry coupling to a living organism, the body jewelry having a shaft extending between a first end and a second end for traversing the living organism, the first end of the shaft including a first threading, a bead defining a bead shape and a bead dimension, the bead having a second threading threadably engaging the first threading of the shaft for securing the bead to the shaft, the bead prohibiting the body jewelry from being withdrawn from the living organism, the jewelry tool, comprising:

a tubular body having an exterior surface and an interior surface extending between a primary end and a secondary end;

said interior surface of said tubular body defining an interior chamber extending between said primary end and said second secondary end;

said primary end having a primary aperture for accessing said interior chamber;

a tubular core extending between a major end and a minor end defining an outer surface;

said tubular core being made of a deformable polymeric material;

said outer surface of said tubular core positioning adjacent to said interior surface of said tubular body for securing said major end of said tubular core adjacent to said primary end of said tubular body;

a bead bore defining a bore dimension and traversing into said tubular core from said major end of said tubular core;

said bore dimension of said bead bore less than the bead dimension of the bead for deforming said bead bore upon insertion of the bead into said bead bore;

said bead bore receiving the bead for creating a friction couple; and said friction couple securing the bead relative to said tubular body and transferring a rotational force from said tubular body to the bead for threadably engaging and disengaging the second threading of the bead with the first threading of the shaft.

2. A jewelry tool for engaging a body jewelry as set forth in claim 1, wherein said secondary end having a secondary aperture for accessing said interior chamber;

a second tubular core extending between a major end and a minor end defining a second outer surface;

said second tubular core being made of a deformable polymeric material;

said second outer surface of said second tubular core positioning adjacent to said interior surface of said tubular body for securing said major end of said second tubular core adjacent to said secondary end of said tubular body;

a second bead bore defining a second bore dimension and traversing into said second tubular core from said major end of said second tubular core;

said second bore dimension of said second bead bore less than the bead dimension of the bead for deforming said second bead bore upon insertion of the bead into said second bead bore;

said second bore dimension of said second bead bore greater than the bore dimension of the bead bore for accommodating beads with various dimensions;

said second bead bore receiving the bead for creating a second friction couple; and said second friction couple securing the bead relative to said tubular body and transferring a rotational force from said tubular body to the bead for threadably engaging and disengaging the second threading of the bead with the first threading of the shaft.

3. A jewelry tool for engaging a body jewelry as set forth in claim 1, wherein said primary end of said tubular body including an inner arcuate lip for increasing the contact surface area between said interior surface of said tubular body and said outer surface of said tubular core and preventing said tubular core from being displaced from said tubular body during disengaging of the bead from said bead bore.

4. A jewelry tool for engaging a body jewelry as set forth in claim 1, wherein said bead bore includes a conical bore having an exterior dimension at said major end of said tubular core and an interior dimension within said tubular core; and said exterior dimension of said conical bore being greater than said interior dimension of said conical bore for directing the bead into said bead bore.

5. A jewelry tool for engaging a body jewelry as set forth in claim 1, wherein said bead bore includes a conical bore having an exterior dimension at said major end of said tubular core and an interior dimension within said tubular core;

said exterior dimension of said conical bore being greater than said interior dimension of said conical bore for directing the bead into said bead bore;

said bead bore further including a central bore defining a central bore dimension and traversing into said tubular core from said conical bore; and said central bore dimension equivalent to said interior dimension of said conical bore for receiving the bead within said bead bore.

6. A jewelry tool for engaging a body jewelry as set forth in claim 1, wherein said bead bore includes a conical bore having an exterior dimension at said major end of said tubular core and an interior dimension within said tubular core;

said exterior dimension of said conical bore being greater than said interior dimension of said conical bore for directing the bead into said bead bore;

said bead bore further including a central bore defining a central bore dimension and traversing into said tubular core from said conical bore;

said central bore dimension equivalent to said interior dimension of said conical bore for receiving the bead within said bead bore;

said bead bore further including a bead cavity defining a cavity dimension and traversing into said tubular core from said central bore; and said cavity dimension greater than said central bore dimension for locking the bead within said bead cavity.

7. A jewelry tool for engaging a body jewelry as set forth in claim 1, wherein said bead bore includes a conical bore having an exterior dimension at said major end of said tubular core and an interior dimension within said tubular core;

said exterior dimension of said conical bore being greater than said interior dimension of said conical bore for directing the bead into said bead bore;

said bead bore further including a bead cavity defining a cavity dimension and traversing into said tubular core from said conical bore;

said cavity dimension greater than said interior dimension of said conical bore for locking the bead within said bead cavity; and said bead cavity defining a cavity shape equivalent to the bead shape of the bead for increasing the contact area between the bead and said bead bore.

8. A jewelry tool for engaging a body jewelry as set forth in claim 1, wherein said exterior surface of said tubular body includes a textured surface for assisting in grasping said tubular body and applying a rotational force to said tubular body.

9. A jewelry tool for engaging a body jewelry, the body jewelry coupling to a living organism, the body jewelry having a shaft extending between a first end and a second end for traversing the living organism, the first end of the shaft including a first threading, a bead defining a bead shape and a bead dimension, the bead having a second threading threadably engages the first threading of the shaft for securing the bead to the shaft, the bead prohibiting the body jewelry from being withdrawn from the living organism, the jewelry tool, comprising:

a tubular body having an exterior surface and an interior surface for extending between a primary end and a secondary end;

said interior surface of said tubular body defining an interior chamber extending between said primary end and said second secondary end;

said primary end having a primary aperture for accessing said interior chamber;

a tubular core extending between a major end and a minor end for defining an outer surface;

said outer surface of said tubular core positioning adjacent to said interior surface of said tubular body for securing said major end of said tubular core adjacent to said primary end of said tubular body;

a bead bore defining a bore dimension and traversing into said tubular core from said major end of said tubular core;

said bore dimension of said bead bore less than the bead dimension of the bead for displacing said bead bore relative to the bead;

said bead bore receiving the bead for creating a friction coupling;

said friction coupling securing the bead relative to said tubular body and transferring a rotational force from said tubular body to the bead for threadably engaging and disengaging the second threading of the bead with the first threading of the shaft;

said secondary end having a secondary aperture for accessing said interior chamber;

a second tubular core extending between a major end and a minor end for defining a second outer surface;

said second outer surface of said second tubular core positioning adjacent to said interior surface of said tubular body for securing said major end of said second tubular core adjacent to said secondary end of said tubular body;

a second bead bore defining a second bore dimension and traversing into said second tubular core from said major end of said second tubular core;

said second bore dimension of said second bead bore less than the bead dimension of the bead for displacing said second bead bore relative to the bead;

said second bore dimension of said second bead bore greater than the bore dimension of the bead bore for accommodating beads with various dimensions;

said second bead bore receiving the bead for creating a second friction coupling; and said second friction coupling securing the bead relative to said second tubular body and transferring a rotational force from said tubular body to the bead for threadably engaging and disengaging the second threading of the bead with the first threading of the shaft.

10. A jewelry tool for engaging a body jewelry, the body jewelry coupling to a living organism, the body jewelry having a shaft extending between a first end and a second end for traversing the living organism, the first end of the shaft including a first threading, a bead defining a bead shape and a bead dimension, the bead having a second threading threadably engages the first threading of the shaft for securing the bead to the shaft, the bead prohibiting the body jewelry from being withdrawn from the living organism, the jewelry tool, comprising:

a tubular body having an exterior surface and an interior surface for extending between a primary end and a secondary end;

said interior surface of said tubular body defining an interior chamber extending between said primary end and said second secondary end;

said primary end having a primary aperture for accessing said interior chamber;

a tubular core extending between a major end and a minor end for defining an outer surface;

said outer surface of said tubular core positioning adjacent to said interior surface of said tubular body for securing said major end of said tubular core adjacent to said primary end of said tubular body;

a bead bore defining a bore dimension and traversing into said tubular core from said major end of said tubular core;

said bore dimension of said bead bore less than the bead dimension of the bead for displacing said bead bore relative to the bead;

said bead bore receiving the bead for creating a friction coupling;

said friction coupling securing the bead relative to said tubular body and transferring a rotational force from said tubular body to the bead for threadably engaging and disengaging the second threading of the bead with the first threading of the shaft;

said primary end of said tubular body including an inner arcuate lip for increasing the contact surface area between said interior surface of said tubular body and said outer surface of said tubular core and preventing said tubular core from being displaced from said tubular body during disengaging of the bead from said bead bore;

said bead bore includes a conical bore having an exterior dimension at said major end of said tubular core and an interior dimension within said tubular core; and said exterior dimension of said conical bore being greater than said interior dimension of said conical bore for directing the bead into said bead bore.

* * * * *